US005706618A

United States Patent [19]

Pratt

[11] Patent Number: 5,706,618

[45] Date of Patent: Jan. 13, 1998

[54] ROOF RIDGE VENTILATOR COVER

[76] Inventor: Charles F. Pratt, 11590 Dueling Oaks Ct., Pensacola, Fla. 32514-9732

[21] Appl. No.: 521,950

[22] Filed: Aug. 31, 1995

[51] Int. Cl.[6] ..... E04B 7/00; E04C 1/30; E04C 13/17

[52] U.S. Cl. ..... 52/199; 52/3; 52/57; 52/309.8; 454/365; 454/364

[58] Field of Search ..... 52/199, 198, 57, 52/4.23, 720.1, 717.05, 717.06, 309.8, 3; 454/365, 364

[56] References Cited

U.S. PATENT DOCUMENTS

| | | | |
|---|---|---|---|
| 595,960 | 12/1897 | May | 454/365 |
| 1,307,228 | 6/1919 | Wickstrom . | |
| 1,401,208 | 12/1921 | Sylvan | 52/199 |
| 1,914,132 | 6/1933 | Kenney | 52/720.1 |
| 2,071,666 | 2/1937 | Sylvan | 52/199 X |
| 2,214,183 | 9/1940 | Seymour | 52/199 X |
| 2,984,945 | 5/1961 | Campbell | 52/57 X |
| 3,098,267 | 7/1963 | Dean et al. | 52/473 X |
| 3,185,070 | 5/1965 | Smith . | |
| 3,326,113 | 6/1967 | Smith et al. | 454/365 |
| 4,322,924 | 4/1982 | Cooper | 52/57 |
| 4,532,739 | 8/1985 | Cooper | 52/57 |
| 5,326,187 | 7/1994 | St. Marie et al. | 52/717.05 X |

FOREIGN PATENT DOCUMENTS

| | | | |
|---|---|---|---|
| 1784653 | 8/1971 | Germany | 52/57 |
| 2017537 | 10/1971 | Germany | 52/57 |
| 2846025 | 4/1980 | Germany | 52/199 |

*Primary Examiner*—Robert Canfield
*Attorney, Agent, or Firm*—Carnes, Cona and Dixon

[57] ABSTRACT

The present invention provides for a roof ridge ventilator cover that is adapted to be removably secured to a conventional roof ridge ventilator. The roof ridge ventilator cover of the present invention, when installed on a conventional roof ridge ventilator, will cover and block the air vents of the ventilator. The roof ridge ventilator cover generally includes two panels serving to cover and block the two panels of air louvers or vents of the roof ridge ventilator. The roof ridge ventilator cover may be made from sheet aluminum or other sheet material, including sheet made of plastic, having sufficient resilience to return unaided to a formed shape after some deflection. The roof ridge ventilator cover is installed by deflecting the cover sufficiently so the cover may be placed over the top portion of the roof ridge ventilator. The resilience of the roof ridge ventilator cover urges the cover back to an original shape to effectuate blocking the air vents of the roof ridge ventilator and further to connect the cover to the ventilator.

7 Claims, 3 Drawing Sheets

ROOF RIDGE VENTILATOR COVER

BACKGROUND OF THE INVENTION

1. Field of the Invention

The present invention relates generally to a means of reducing energy consumption in a building during the winter months, and more particularly to a cover that is adapted to be removably secured to a roof ridge ventilator.

2. Description of the Related Art

Roof ridge ventilators are installed on openings in the ridges of roofs of buildings to exhaust heated air from the space below the roof, commonly named the attic. Roof ridge ventilators are usually installed along with other ventilators located in the eaves of the roofs of buildings.

When air in an attic is heated, natural convective currents form as heated air rises and subsequently exits the attic through the roof ridge ventilator. As heated air rises, air is drawn into the ventilator located in the eaves, replenishing the air that exits the attic through the roof ridge ventilator. The natural convective currents thus formed generally reduce the temperature in the attic.

One such roof ridge ventilator is disclosed in U.S. Pat. No. 1,307,228 issued to Wickstrom. Wickstrom discloses a ventilating ridge-roll for buildings. This ventilating ridge roll is fabricated from a sheet of metal which is secured to the roof of a building. This ventilating ridge is provided with vents for enabling air to flow, while preventing water, snow, or the like from entering through the roof.

Yet another ventilator is disclosed in U.S. Pat. No. 3,185,070 issued to Smith. Smith discloses an improved ventilator, including vent openings, that is secured to the roof of a building. This ventilator is designed and constructed to be low in production costs and easily installable.

The conventional roof ridge ventilators, such as the ones described above, provide a very efficient means of removing solar heated air from attics in the summer. Reducing attic temperatures inherently reduces energy consumption and lowers the cost of operating buildings requiring cooling for the comfort of occupants. Disadvantageously, these roof ridge ventilators remaining uncovered allow solar heated air to escape during winter, too, when solar heated air would desirably remain in the attic. The roof ridge ventilator cover of the present invention blocks roof ridge ventilators to keep heated air in attics when appropriate, typically during winter, reducing the demand on the heating systems of buildings, reducing energy consumption and lowering the cost of operating buildings requiring heat for the comfort of occupants.

BRIEF SUMMARY OF THE INVENTION

The roof ridge ventilator cover of the present invention is preferably formed of sheet aluminum, other sheet material, plastic or the like, and is adapted to be removably secured to a conventional roof ridge ventilator. The cover of the present invention is designed and constructed to provide an efficient means for blocking the vents of common roof ridge ventilators. For easy installation and removal over roof ridge ventilators, the roof ridge ventilator cover may be fabricated in short sections. This configuration will render a device so as to enable the user to quickly and efficiently install or remove the cover with minimal effort.

The roof ridge ventilator cover of the present invention is comprised of a top and a blocking means. The blocking means extends downwardly from the distal ends of the top for providing a gap or throat opening to exist between the blocking means. This blocking means is designed so as to cover and block the vent openings in a conventional roof ridge ventilator.

The present invention is installed or removed by deflecting the cover. In order to do so, the blocking means is pulled outwardly for inherently increasing the throat opening sufficiently to slip the cover over on or off the conventional roof ridge ventilator. The resilience of the roof ridge ventilator cover urges the cover back to original shape, which once installed will cause the blocking means to block the vents of the roof ridge ventilator while connecting itself to the ventilator.

By blocking the vents during the winter months, the roof ridge ventilator cover will reduce heating costs and provide energy savings while demonstrating reduction of the energy demand on the heating systems of buildings requiring heat for the comfort of occupants.

Accordingly, it is an object of the present invention to provide a roof ridge ventilator cover that provides means for blocking the vents of conventional roof ridge ventilators for preventing the exhaust of heated attic air while providing a means of reducing energy consumption in a building during relatively cold periods.

It is another object of the present invention to provide a roof ridge ventilator cover that is light weight, simple to handle, easy to install, so as to provide a device that is economically feasible, long lasting and relatively trouble free in operation.

It is yet another object of the present invention to provide a roof ridge ventilator cover that is inexpensive to fabricate and easily made by common manufacturing methods from readily available material.

The foregoing outlines some of the more pertinent objects of the present invention. These objects should be construed to be merely illustrative of some of the more prominent features and application of the present invention. Other beneficial results may be obtained by applying the disclosed invention in different manners or by modifying the invention within the scope of the disclosure. Accordingly, a fuller understanding of the present invention may be had by referring to the detailed description of the preferred embodiments, the accompanying drawings and the scope of the invention defined by the claims.

BRIEF DESCRIPTION OF DRAWINGS

Similar reference numerals refer to similar parts throughout the views of the drawings.

DESCRIPTION OF PREFERRED EMBODIMENT

Figure 1A:
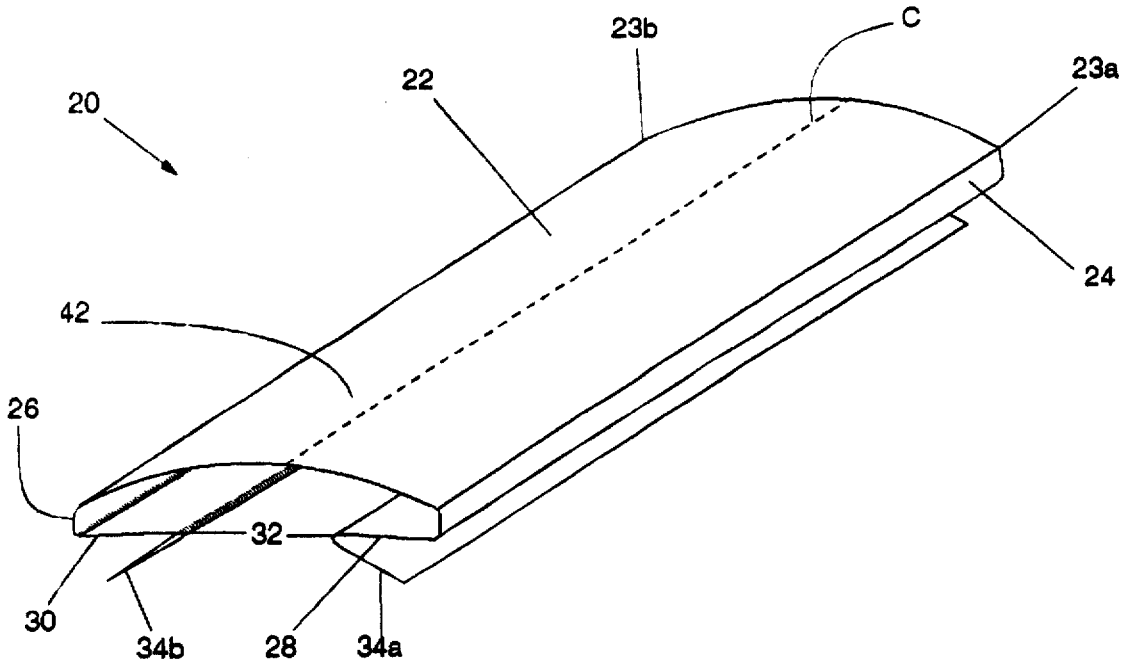
FIG. 1*a* is a perspective view of a first embodiment of a roof ridge ventilator cover of the present invention.
Figure 1B:
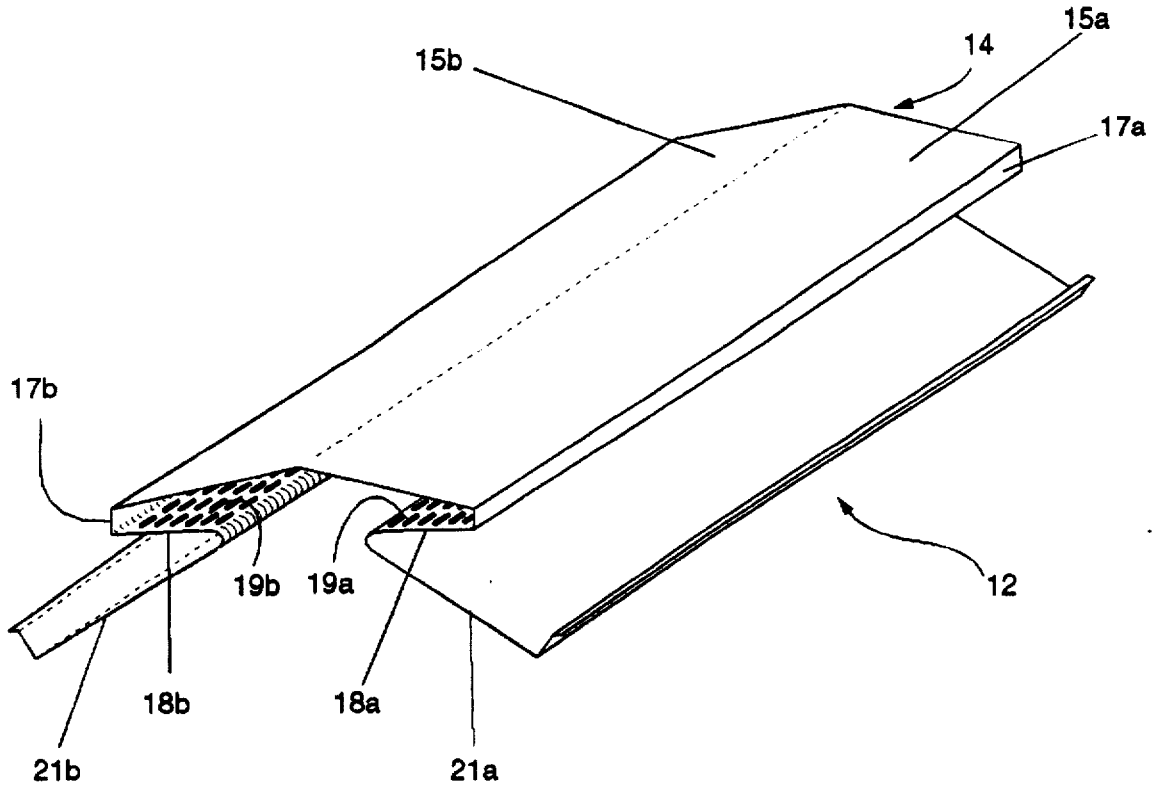
Figure 1b (PRIOR ART)
FIG. 1*b* is a perspective view of a conventional roof ridge ventilator.

Roof ridge ventilators are typically installed on openings in the ridges of roofs of buildings to exhaust heated air from the space below the roof, commonly known as attics. This system provides an efficient means of removing heated air from attics in the summer. Reducing attic temperatures inherently reduces energy consumption and lowers the cost of operating buildings requiring cooling for the comfort of occupants.

Such a conventional roof ridge ventilator is illustrated in FIGS. 1b–3. As seen in these figures, a conventional roof ridge ventilator 12 includes a top portion 14. This top portion 14 includes a first side panel 15a and a second side panel 15b. These panels meet at a center point of the top portion 14. Extending downwardly from the first side panel 15a and second side panel 15b are a first outer side 17a and a second outer side 17b, respectively. A set of louvered panels 18a and 18b extend from sides 17a and 17b, respectively, inwardly toward one another. Incorporated in panels 18a and 18b are a plurality of louvers or vents, 19a and 19b, respectively. These louvers or vents 19a and 19b are formed to allow heated attic air to be ventilated. Extending outwardly from the louvered panels 18a and 18b are attaching panels 21a and 21b. These attaching panels 21a and 21b permit the ventilator to be secured to a conventional roof.

Though this assembly is efficient for removing solar heated air from attics during periods of high temperature, this system is inefficient during winter months. Disadvantageously, these roof ridge ventilators allow solar air to escape during periods of cold temperatures. The roof ridge ventilator cover 20 of the present invention blocks the louvers or vents 19a and 19b in the conventional roof ridge ventilator 12 for keeping heated air in attics when appropriate, typically during winter, reducing the demand on the heating systems of buildings, while inherently reducing energy consumption.

The first embodiment of the roof ridge ventilator cover 20 of the present invention is illustrated in further detail in FIGS. 1a–3. As seen in these figures, the roof ridge ventilator cover 20 is comprised of a first blocking means 28 and a second blocking means 30, that are adapted to block the louvers or vents 19a and 19b in a conventional roof ridge ventilator 12, and a connecting means 42 for connecting and maintaining the first blocking means 28 and second blocking means 28. These blocking means are constructed as panels.

The connecting means 42 is illustrated in these figures as an unitary structure for connecting the first blocking means 28 to the second blocking means 30. This unitary structure is a first embodiment for the connecting means. As seen in these figures, the connecting means comprises a top portion 22. This top portion 22 generally has a convex or arched shape including a central region C, a first edge 23a and a second edge 23b. Extending downwardly from the first edge 23a and the second edge 23b is a first side panel 24 and a second side panel 26, respectively. The top portion 22, first side panel 24 and second side panel 26 constitute the connecting means 42 of the first embodiment.

These side panels 24 and 26, respectively will enable the cover of the present invention to conform to the shape and configuration of a conventional roof ridge ventilator once the cover is attached to the roof ridge ventilator. Additionally, these side panels will ensure a snug and secure fit of the cover to the roof ridge ventilator.

The connecting means is designed and configured to connect the first blocking means to the second blocking means. To conserve material and to reduce the cost of the roof ridge ventilator cover 20 of the present invention, the connecting means can be reconfigured for providing for the connecting means to be a non-unitary structure. These reconfigurations are illustrated in further detail in FIGS. 5–7.

As seen in FIG. 5, the second embodiment of the connecting means 42 is illustrated as a plurality of straps 44. Once the ventilator cover 20 is secured to a conventional roof ridge ventilator, the straps 44 will extend horizontally across the top portion of the conventional roof ridge ventilator. In this embodiment, the first and second blocking means will not only block the vents in the roof ridge ventilator, but will also act as a securing means.

The third and fourth embodiments of the connecting means 42, are illustrated in FIG. 6. As seen in this drawing, the straps are replaced with either bungee cords 46 or rubber bands or elastic straps 48. The use of elastic material enables easy installation for the user. When the ventilator cover 20 is attached to the conventional roof ridge ventilator, the elastic material 46 and 48, like the straps, will extend horizontally across the top portion of the conventional roof ridge ventilator. As seen in the drawing the bungee cord is cylindrical to provide for a circular cross section while the rubber bands or elastic straps provide for a rectangular cross section.

Yet another embodiment for the connection means is illustrated in FIG. 7. As seen in these drawings, the connecting means comprises a plurality of extension springs 50. These springs 50 provide yet another means of connection the first blocking means to the second blocking means and behave in the same manner as the bungee cord or elastic straps as illustrated and discussed in FIG. 6.

The first blocking means 28 and the second blocking means 30, as illustrated in FIGS. 1 –7, extend from outer sides 23a and 23b, respectively, inwardly toward one another in a generally horizontal plane. Foam, insulation, or the like, illustrated as numeral 44 in FIG. 4, may be interiorly secured to the first blocking means 28 and the second blocking means 30. A gap or throat opening 32 exists between the first blocking means 28 and second blocking means 30. The first blocking means 28 and second blocking means 30 cover and block the plurality of louvers or vents 19a and 19b in a conventional roof ridge ventilator cover 12.

A first flange 34 and a second flange 36 may be used to secure the cover 20 to a conventional roof ridge ventilator 12. These flanges 34 and 36 would extend outwardly and downwardly from the inner edges of the first blocking means 28 and second blocking means 30, respectively.

The roof ventilator cover 20 of the present invention, is preferably formed from a resilient, deflectable plastic or rubber material. However, it could also be formed of a sufficiently resilient, deflectable metallic material. Those skilled in the relevant art understand the selection of appropriate material is based on a compromise of strength, durability, resiliency, and resistance to adverse environmental conditions.

Figure 2:
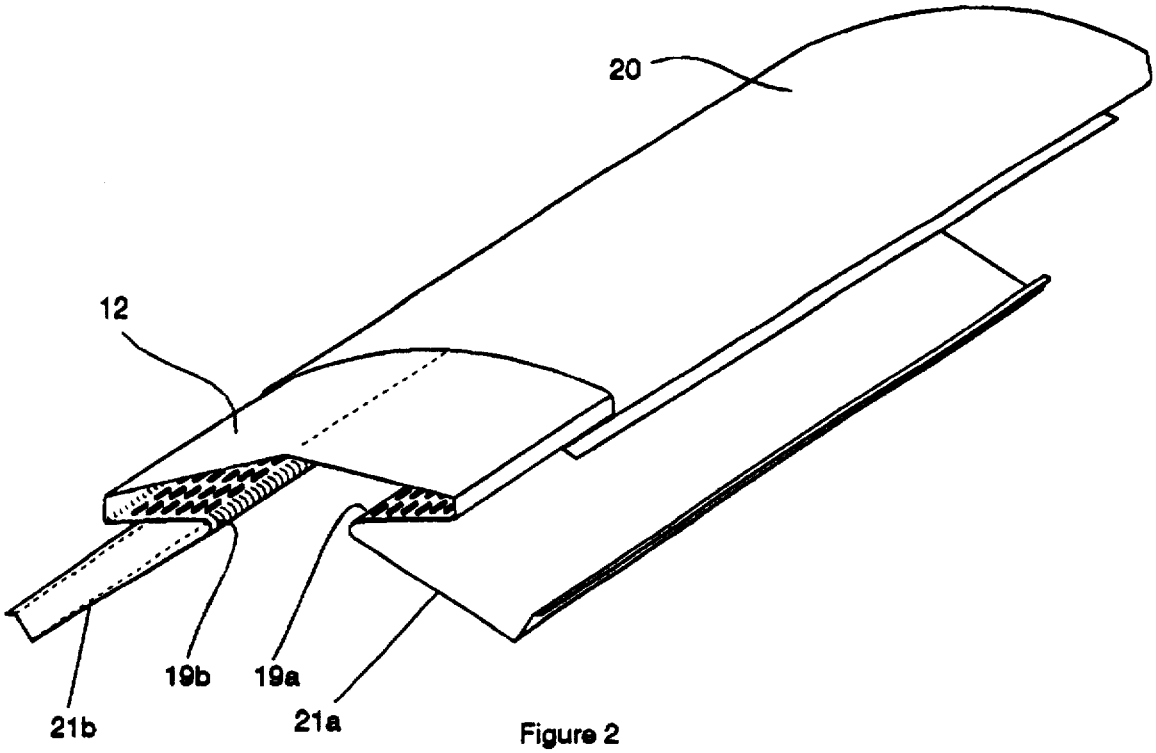
FIG. 2 is a perspective view of the first embodiment of the roof ridge ventilator cover partially covering a conventional roof ridge ventilator.
Figure 3:
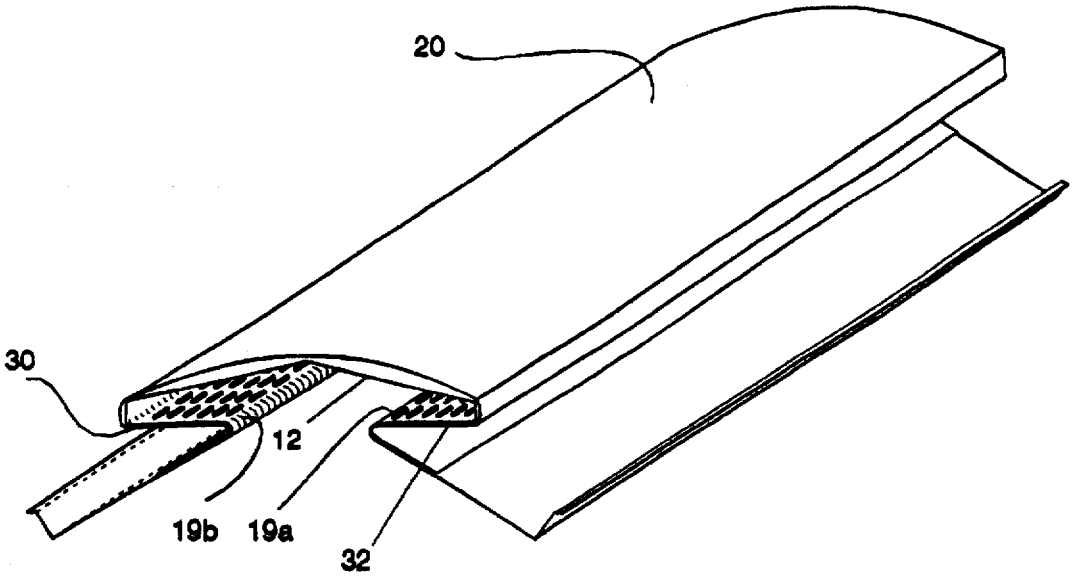
FIG. 3 is a perspective view of the first embodiment of the roof ridge ventilator cover fully covering a conventional roof ridge ventilator.

As seen in FIGS. 2 and 3, the cover 20 of the present invention is adapted to be removably secured to the conventional roof ridge ventilator cover 12. The design and configuration of the cover 20 of the present invention will enable the blocking means 28 and 30 or side panels 24 and 26 to prevent air from escaping through the plurality of louvers or vents 19a and 19b. Accordingly, in order to utilize the cover 20 of the present invention, a user would merely widen the throat opening 32. Once widened, the opening 32 is adapted to receive the top portion 14 of the conventional roof ridge ventilator 12. The widened opening 32 is adapted to engage the louvered panels 18a and 18b of the conventional ventilator 12. After the first blocking means 28 and second blocking means 30 are located under the louvers or vents 19a and 19b, the user releases the cover 20. Due to the cover's resiliency, the roof ridge ventilator cover 20 will return to its normal size and will inherently provide for the first blocking means 28 and second blocking means 30 to block the louvers or vents 19*a* and 19*b*, thereby preventing the ventilation of heated attic air.

The above described embodiment can be altered and simplified to provide for a cover 20 which includes fewer elements and adapts to fit and cover any type or style conventional roof ridge ventilator 12. This alteration is illustrated in further detail in FIG. 4, the second embodiment of the roof ridge ventilator cover 20 of the present invention. As seen in this figure, the ridge ventilator cover 20 includes a top portion 22 that is planar, however, this top portion 22 can be slightly convex as illustrated in the previous embodiment. This top portion 22 includes a first edge 23*a* and a second edge 23*b*. A first curved portion 38 connects to the right edge 23*a* of the top portion 22. A second curved portion 40 connects to the left edge 23*b* of the top portion 22. The first curved portion 38 and second curved portion 40, while curving and extending toward each other, preferably end before contacting each other, forming a throat opening 32. The throat opening 32 must be sized, taking notice of the resilience of the particular material used for the roof ridge ventilator cover 20, such that the throat opening 32 may be increased sufficiently to allow the roof ridge ventilator cover 20 to slip over a conventional roof ridge ventilator 12 by deflecting the roof ridge ventilator cover 20, yet spring back to near original shape.

Figure 4:
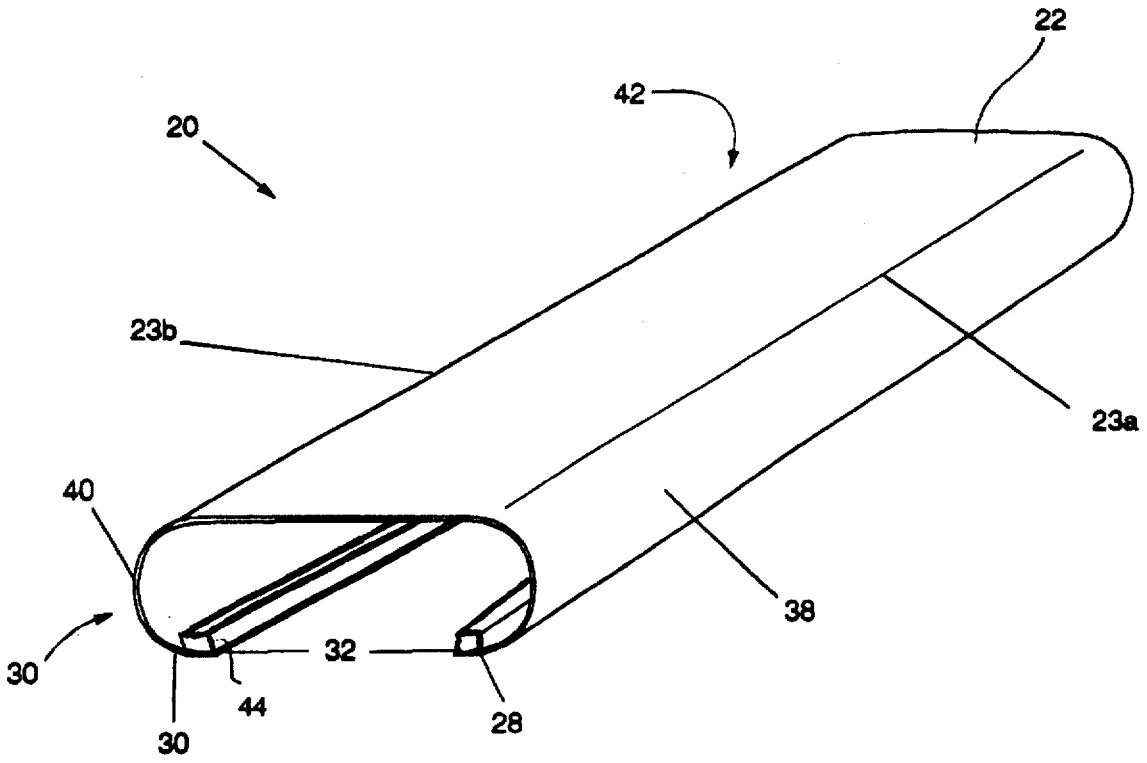
FIG. 4 is a perspective view of a second embodiment of a roof ridge ventilator cover of the present invention.

The second embodiment of the roof ridge ventilator cover 20 shown in FIG. 4 is employed by grasping the curved portions 38 and 40 at the throat opening 32 and widening the throat opening 32 by deflecting the cover 20. When the throat opening 32 is sufficiently widened, the cover 20 is placed over the roof ridge ventilator 12. When released, the cover 20 springs back to near original shape so the curved portions 38 and 40 act as the first and second blocking means 28 and 30, respectively. The top portion 22 provides the connecting means 42.

Although not illustrated, roof ridge ventilator covers 20 may be supplied in any length. Covers 20 may be supplied in long sections for speed of installation in commercial or professional environments. Covers 20 may be supplied in short sections for ease of use in homeowner or residential environments.

While the invention has been particularly shown and described with reference to the embodiments thereof, it will be understood by those skilled in the art that various changes in form and detail may be made without departing from the spirit and scope of the invention.

I claim:

1. A roof ridge ventilator cover to be used in combination with a roof ridge ventilator having a first panel of vents and a second panel of vents, said roof ridge ventilator comprising:

a first blocking means;

a second blocking means;

a connecting means for connecting said first blocking means and said second blocking means; and a layer of foam is interiorly secured to each of said first blocking means and said second blocking means.

2. A roof ridge ventilator cover as in claim 1 wherein a first flange extends outwardly and downwardly from said first blocking means and a second flange extends outwardly and downwardly from said second blocking means.

3. A roof ridge ventilator cover as in claim 1 wherein said first blocking means further includes a first panel and said second blocking means further includes a second panel.

4. A roof ridge ventilator as in claim 1 wherein said first blocking means further is a first curved portion and said second blocking means further includes a second curved portion.

5. A roof ridge ventilator cover as in claim 1 wherein a gap or throat is located between said first blocking means and said second blocking means.

6. A roof ridge ventilator cover in combination with a roof ridge ventilator having a first panel of vents and a second panel of vents, said cover comprising:

a first blocking means which covers and engages a first panel having a plurality of vents located in a roof ridge ventilator for covering said vents;

a first flange extends outwardly and downwardly from said first blocking means for securing the cover to said roof ridge ventilator;

a second blocking means which covers and engages a second panels having a plurality of vents located in said roof ridge ventilator for covering said vents;

a second flange extends outwardly and downwardly from said second blocking means for securing the cover to said roof ridge ventilator;

said first blocking means and said second blocking means are continuous to cover said roof ridge ventilator which expands entirely across a conventional roof;

said first flange and said second flange contact and engage said roof ridge ventilator;

a connecting means for connecting said first blocking means and said second blocking means and said connecting means contacts a top surface of said roof ridge ventilator for prohibiting a gap to exist between said top surface of said roof ridge ventilator and said connecting means; and said roof ridge ventilator cover is secured to said roof ridge ventilator for providing said roof ridge ventilator cover to be snugly secured to said roof ridge ventilator for prohibiting air to escape from said first panel of vents and said second panel of vents.

7. A roof ridge ventilator cover in combination with a roof ridge ventilator as claimed in claim 6 further comprising a layer of foam interiorly secured to each of said first blocking means and said second blocking means.

* * * * *